United States Patent [19]

Yamashita et al.

[11] 4,412,908

[45] Nov. 1, 1983

[54] PROCESS FOR THERMAL HYDROCRACKING OF COAL

[75] Inventors: Kunihiko Yamashita, Kurashiki; Muneaki Kimura, Fuji, both of Japan

[73] Assignee: Asahi Kasei Kogyo Kabushiki Kaisha, Osaka, Japan

[21] Appl. No.: 366,125

[22] Filed: Apr. 7, 1982

[30] Foreign Application Priority Data

Apr. 7, 1981 [JP] Japan ..... 56-52162
Jun. 8, 1981 [JP] Japan ..... 56-87813

[51] Int. Cl.[3] ..... C10G 1/06
[52] U.S. Cl. ..... 208/8 R; 208/107
[58] Field of Search ..... 208/8 R, 107

[56] References Cited

U.S. PATENT DOCUMENTS 3,044,951 7/1962 Schlinger et al. ..... 208/107
3,960,700 6/1976 Rosen et al. ..... 208/8 R
4,003,820 1/1977 Pelofsky et al. ..... 208/8 R
4,243,509 1/1981 Sinor ..... 208/8 R

*Primary Examiner*—Delbert E. Gantz
*Assistant Examiner*—Lance Johnson
*Attorney, Agent, or Firm*—Sughrue, Mion, Zinn, Macpeak and Seas

[57] ABSTRACT

A process for liquefying and gasifying coal by thermal treatment in the presence of hydrogen gas for hydrocracking is disclosed. The process comprises a sequence of the following two steps:

(1) coal fines are injected into a heated hydrogen gas stream at a pressure of from 35 to 250 kg/cm G such that they are rapidly heated to a temperature of from 750° to 1100° C. for thermal cracking thereof; and (2) the resulting liquid product is subjected to hydrocracking for a period of from 1.0 to 60 seconds at a temperature that is lower than the temperature used in the first step and which is in the range of from 570° to 850° C.

10 Claims, No Drawings

PROCESS FOR THERMAL HYDROCRACKING OF COAL

FIELD OF THE INVENTION

The present invention relates to a new process for direct manufacture of liquefied oil and gas by thermally cracking coal in the presence of hydrogen, and more particularly, to a new process for rapid thermal cracking of coal in the presence of hydrogen.

BACKGROUND OF THE INVENTION

With the recent concern over the depletion of oil resources, coal, the most abundant and prevalent of all fossil fuel resources and which once had become disfavoured in the competition with petroleum, is being newly considered as an oil substitute. However, as a very complex high molecular weight compound, coal contains not only carbon and hydrogen, the two primary components, but also signficant amounts of hetero atoms (oxygen, nitrogen and sulfur) as well as ash. Therefore, if it is simply burned, a large amount of air pollutants is generated, and the heating value of coal is not as high as oil. Furthermore, coal is more difficult to transport and store than oil.

To solve these problems inherent in coal, many processes have been proposed for liquefying coal to remove hetero atoms and ash, and obtain clean fuel oils and gases and various chemical materials having great commercial value. Typical processes include: (1) extracting coal with a solvent; (2) liquefying coal in the presence of hydrogen or a hydrogen donator; (3) liquefying and gasifying coal in the presence of hydrogen; (4) liquefying and gasifying coal in an inert gas.

A process is known for heating coal to obtain light oils and gas directly; in this method, a finely ground coal powder is injected into a hydrogen gas stream at high temperature and pressure for completing hydrogenation and thermal cracking of the coal within a very short period of several tens of milli-seconds to several minutes. More specifically, coal fines are injected into a hydrogen gas stream at a pressure of from 50 to 250 kg/cm$^2$G and a temperature of from 600° to 1,200° C. to heat the coal rapidly at a rate of from $10^{2}$° to $10^{3}$° C./sec for achieving both hydrogenation and thermal cracking of the coal. Methane, ethane, carbon dioxide, carbon monoxide, steam, hydrogen sulfide, and ammonia are formed as gaseous products; a gasoline fraction and heavy oils (aromatic compounds having 10 or more carbon atoms, and high-boiling tar) are formed as liquid products; and a solid product containing ash (referred to as "char") is obtained. But at low reaction temperatures, this process achieves only a low percent total conversion of coal into liquid or gas (the percent total conversion being defined as a hundred times the quotient of the number of carbon atoms in the total product as divided by the number of carbon atoms in the coal feed), and the principal product comprises aromatic compounds having 10 or more carbon atoms and heavy oils such as tar. If the reaction temperature is high, the percent total conversion is increased, but then, methane is the principal product, with a low percent conversion to light oils.

In an improved version of this method, coal particles as fine as 100 mesh or more are injected into a high-speed hydrogen gas stream to heat the coal at an increased rate of from 1,000° to 10,000° C./sec, and the reaction is completed at 700° to 800° C. within 2 to 10 seconds. By this improved method, the formation of methane is inhibited and yet the percent conversion into a gasoline fraction and other light oils is increased. However, even this improvement is unable to produce the gasoline fraction in a satisfactory high yield.

A method has been attempted wherein coal is hydrogenated and thermally cracked rapidly within a period of 20 milli-seconds to 2 seconds with a heating speed of $10^{4}$° C./sec or more at a reaction temperature of from 800° to 1100° C. and a pressure of from 35 to 100 kg/cm$^2$G (gauge pressure). If a very short period of 20 to 800 milli-seconds is used, conversion to a liquid product is as high as from 30 to 45 wt%, but conversion to the gasoline fraction is as low as from 3 to 8 wt%, and if the reaction time is prolonged, only the conversion to gases is increased, while the conversion to the gasoline fraction is decreased further.

SUMMARY OF THE INVENTION

As a result of various studies to develop a process for improving the percent conversion to the gasoline fraction in the prior art technique, the present inventors have found: that the gasoline fraction is formed not only directly from coal, but also indirectly by hydrogenation of the intermediate liquid product; that when the overall reaction is considered, the production of the gasoline fraction by the hydrogenation predominates over the direct production of the gasoline fraction from coal; and that therefore, the absolute amount of the liquid product must be increased in order to improve the percent conversion to the gasoline fraction. The present invention has been accomplished on the basis of these findings.

Therefore, the present invention provides a process for thermal hydrocracking of coal that produces a gasoline fraction from coal in high yield and which achieves great savings of the hydrogen for hydrogenation by inhibiting the formation of methane gas due to the hydrogenation of by-products such as ethane.

According to the process of the present invention, coal is liquefied and gasified by thermal treatment in the presence of hydrogen gas through a sequence of the following two steps;

step (1): coal fines are injected into a heated hydrogen gas stream at a pressure of from 35 to 250 kg/cm$^2$G such that they are rapidly heated to a temperature of from 750° to 1100° C. for thermal cracking thereof; and step (2): the resulting liquid product is subjected to hydro-cracking for a period of from 1.0 to 60 seconds at a temperature that is lower than the temperature used in the first step and which is in the range of from 570° to 850° C.

By the process of the present invention, the conversion of coal into methane is suppressed and yet the percent conversion to the gasoline fraction can be increased markedly.

DETAILED DESCRIPTION OF THE INVENTION

Mainly, two processes are believed to be involved in the reaction for converting coal into the gasoline fraction according to the present invention. In one process, which is the first stage, the simple thermal cracking of coal is believed to cause the cleavage of a covalent bond having small dissociation energy, and the resulting free radical induces such reactions as hydrogen stripping, dehydrogenation, recombination and cyclization to produce cracked liquid products. In the other process, which is the second stage, the thermally cracked liquid products are hydrocracked to compounds of lower molecular weight. The reaction in the first stage is believed to be completed in a relatively short period, and the higher the reaction temperature, the faster the cleavage of the covalent bond having small dissociation energy. In the reaction in the second stage, the gasoline fraction is formed by hydrocracking of the liquid products generated in the first stage reaction. To inhibit undesired enhanced hydrocracking of the end product gasoline fraction or by-product ethane into methane, the reaction in the second stage must be carried out at a relatively low temperature. Therefore, the percent conversion from coal to the gasoline fraction can be increased by performing the first stage reaction under conditions that yield a large quantity of the liquid products that can be converted to the gasoline fraction, and by conducting the second stage reaction under such conditions that the heavy oil is hydrocracked at a faster rate than the gasoline fraction.

The reaction conditions for the process of the present invention are described more specifically below. To yield more liquid product, the coal should be heated as quickly as possible, and the heating rate is preferably at least 2,000° C./sec, and more preferably at least 5,000° C./sec. If the reaction temperature for step (1) is too high, more methane is produced and less liquid products are formed. If the reaction temperature is too low, the rate of thermal cracking of the coal is reduced. Therefore, the reaction temperature for step (1) must be in the range of from 750° to 1100° C., and preferably from 800° to 1,050° C. In step (1), the coal must be exposed to a temperature in the stated range momentarily, but if the reaction period is too short, the rate of heating the coal is not fast enough to reach the desired reaction temperature. If the reaction period is too long, more methane is formed and less liquid products are formed. Therefore, the duration of holding the coal at a temperature between 750° C. and 1100° C. is generally from 20 milli-seconds to 1,500 milli-seconds, and preferably from 50 milli-seconds to 800 milli-seconds.

If the reaction temperature for step (2) is too high, the gasoline fraction is decomposed so fast that the selectivity for it is decreased. If the reaction temperature is too low, the liquid products other than the gasoline fraction are decomposed so slowly that the percent conversion to the gasoline fraction is reduced. Therefore, the reaction temperature for step (2) must be in the range of from 570° C. to 850° C., and the range from 600° to 800° C. is preferred. If the reaction period of step (2) is too short, the percent conversion to the gasoline fraction is not much improved. If the reaction period is too long, the gasoline fraction is decomposed too much. Therefore, the reaction period of step (2) must be in the range of from 1.0 to 60 seconds, and a range from 2 seconds to 30 seconds is preferred. The reaction temperatures for each step need not be held constant, and may vary with time if the indicated ranges are observed.

The pressure for step (1) wherein the predominant reaction is the thermal cracking of coal is not greatly affected by the precent conversion of coal into the liquid products. On the other hand, if the pressure for step (2) wherein the predominant reaction is the hydrocracking of the liquid products formed in step (1) is increased, the percent conversion to the gasoline fraction is improved. However, once an adequately high pressure is obtained, a further increase is not accompanied by a corresponding improvement in the percent conversion to gasoline fraction, and instead, it requires an additional facilities cost which is economically disadvantageous.

As mentioned above, the reaction pressure for step (2) is preferably higher than that for step (1), but to provide a compression step between the two steps requires the cooling of the liquid products formed in step (1) and hence is not advantageous both in terms of reaction efficiency and thermodynamics. Therefore, it is preferred that the pressure for step (1) be determined on the basis of the pressure for step (2), the pressure for step (1) being the sum of the pressure for step (2) and the pressure loss (usually negligibly small) in the reaction tube. The reaction pressure for each step is preferably in the range of from 35 to 250 kg/cm$^2$G, and more preferably in the range of from 50 to 200 kg/cm$^2$G.

The weight ratio of the hydrogen supplied in step (1) as reaction gas (hereunder referred to as the hydrocracking hydrogen) to the coal feed (on a moisture- and ash-free basis) veries with the type of coal and the composition of the desired reaction product, and is generally from 0.3/1 to 0.08/1. However, to facilitate the diffusion of the liquid products from the coal, and the diffusion of hydrogen into the pores of the coal particles, as well as to increase the percent conversion of coal into the gasoline fraction and to prevent coking, excess hydrogen is preferably supplied. Excess hydrogen is separated from the reaction products and is recycled to the reactor in step (1) for further use; therefore, using too much hydrogen requires more energy and larger facilities for separation, recycling and heating, and is not economically advantageous. Therefore, the weight ratio of the hydrocracking hydrogen to the coal feed is preferably from 0.1/1 to 1.5/1 and more preferably is from 0.12/1 to 1.0/1.

Between steps (1) and (2), the reaction temperature is lowered rapidly by one of the three methods. In the first method, the reaction product of step (1) is subjected to indirect heat exchange with the hydrocracking hydrogen gas in part of or throughout step (2) so as to quench the reaction product of (1) to the reaction temperature for step (2), and at the same time, to achieve preliminary heating of the hydrocracking hydrogen gas. By this method, both reduction in the reaction temperature and heat recovery can be achieved. The second method is to quench the reaction product of step (1) to the low reaction temperature for step (2) by supplying hydrogen gas whose temperature is lower than the reaction temperature for step (2) when step (1) has been completed. This second method is capable of increasing the partial hydrogen pressure for step (2), as well as the precent conversion to the gasoline fraction and ethane. At the same time, this method is highly effective for preventing coking. The third method is a combination of the first and second methods, wherein the reaction product of step (1) is subjected to indirect heat exchange with the hydrocracking hydrogen gas in part of or throughout step (2), and, at the same time, hydrogen gas whose temperature is lower than the reaction temperature for step (2) is supplied at the end of step (1), to thereby quench the reaction product of step (1) to the low temperature intended for step (2). This method is very effective since it has the advantages of both the first and second methods.

Further improvements in the percent conversion to the gasoline fraction while suppressing the formation of methane gas due to the undesired enhanced hydrocracking of by-product $C_{2-5}$ hydrocarbons, especially ethane, can be accomplished by performing, subsequent to steps (1) and (2), the following sequence of steps (3), (4) and (5):

Step (3): separating char from the reaction product of step (2);

Step (4): cooling the char-free reaction product to separate the heavy oil; and

Step (5): recycling at least part of the separated heavy oil to the end of step (1).

These additional steps are described hereunder described more specifically. The reaction product of step (2) contains char (ash), so it is removed in step (3). For easy separation of char from the reaction product, the latter is preferably held at a temperature that does not cause the liquid products to condense, and such temperature is generally 350° C. or higher. Step (3) may be incorporated in step (2). The reaction product from which the char has been separated is cooled in step (4) for separation of the heavy oil. If the heavy oil is the only substance to be separated from the reaction product, a condenser or distillation column is generally used in step (4), and the heavy oil is recovered as bottoms, and those reaction products which are lighter than the gasoline fraction are recovered as the distillate. The separation temperature can be easily determined by the pressure and the composition of the reaction product. In step (5), at least part of the heavy oil obtained in step (4) is recycled to the end of step (1), or to the reaction product of step (1) being transferred to step (2). Since step (5) shortens the residence time of the gasoline fraction or ethane relative to that of the heavy oil in step (2), a maximum amount of the heavy oil is preferably recycled; the heavy oil also functions as a coolant to quench the temperature of the reaction product being transferred from step (1) to (2). Therefore, the volume of the heavy oil to be recycled is determined by thermodynamic considerations. The heavy oil can be recycled after being heated to a vapor state, or by being atomized together with water vapor or hydrogen gas. The pressure for steps (3) and (4) is preferably equal to that for step (2), because if step (4) is performed at high pressure, the bottom from the condenser or distillation column can be obtained at elevated temperatures, so that the heavy oil has low viscosity and is very easy to handle.

According to the process of the present invention, a large amount of liquid product is obtained in step (1), and, in step (4), the heavy oil separated in step (4) is introduced in those products, and so, the desired temperature conditions for step (2) are attained by the latent heat of evaporation or sensible heat of the heavy oil in the substantial absence of external cooling (e.g., cooling by directly supplying hydrogen or water, or cooling by indirect heat exchange). As a further advantage, the heavy oil being recycled is hydrocracked at a faster rate than gasoline, to thereby prolong the substantial cracking of the gasoline fraction. For these reasons, the present invention offers an industrially advantageous process for thermal hydrocracking of coal.

The coal to be supplied to the process of the present invention is preferably ground to the minimum possible particle size. For practical purposes, the coal is conditioned to a size that passes 100 mesh, and preferably 200 mesh or finer mesh. The hydrogen gas used in the process of the present invention is preferably pure, but it may be diluted with up to about 30 vol% of an inert gas, or other gases such as steam, carbon dioxide, carbon monoxide and methane. But any gas that interferes with the hydrocracking, for example, an oxidizing gas such as oxygen, is precluded. The term "coal" as used herein includes anthracite, bituminous coal, sub-bituminous coal, brown coal, lignite, peat and grass peat. The precent conversion (P.C.) of coal into the respective reaction products is defined by the following formula:

$$P.C. = \frac{\text{the number of carbon atoms in the reaction product}}{\text{the number of carbon atoms in the coal feed}} \times 100\ (\%).$$

The present invention is now described in greater detail by reference to the following examples, which are given here for illustrative purposes only, and are not intended to limit its scope.

EXAMPLE 1

Illinois No. 6 coal was ground sequentially by a jaw crusher, brown coal mill, and ball mill. After removing the coarse particles using a 200 mesh sieve, the coal fines were dried with a vacuum drier at about −720 mmHg and 100° C. for 10 hours until 100 parts by weight of the coal contained less than 3 parts by weight of water. The coal analysis on a moisture-free basis was as indicated in Table 1.

TABLE 1

Analysis of Illinois No. 6 Coal

| Element | Percent by Weight |
|---|---|
| Carbon | 69.7 |
| Hydrogen | 4.6 |
| Sulfur | 4.5 |
| Nitrogen | 1.2 |
| Oxygen | 10.1 |
| Ash | 9.9 |
| Total | 100.0 |

Hydrogen gas (1.0 kg/hr) at room temperature (20~30° C.) was heated to 900° C. at 100 kg/cm$^2$G in an externally heated Hastelloy X preheating tube (inside diameter ID=5 mm), and further heated to 1150° C. in an externally heated ceramic heating tube (ID=5 mm) connected to said preheating tube. Dry coal fines (2.5 kg/hr) having ordinary temperature were continuously supplied through a table coal feeder at a pressure of 100 kg/cm$^2$G, carried with hydrogen gas (0.1 kg/hr, 100 kg/cm$^2$G) at room temperature, and injected into the stream of heated hydrogen gas so as to rapidly increase the coal temperature from room temperature up to 930° C. The coal heating rate is assumed to be about $2\times10^5$° C./sec. The mixture of coal and hydrogen gas was passed into an externally heated ceramic reaction tube (ID=6 mm) to perform the first stage reaction (thermal cracking) at 930° C. for 120 milli-seconds. Then, hydrogen gas (0.47 kg/hr, 110 kg/cm G) at room temperature was mixed with the reaction product of the first stage reaction to quench its temperature down to 700° C. At the same time, the mixture was passed into an externally heated stainless steel reaction tube (ID=50 mm) connected to the ceramic reaction tube, and the second stage reaction (hydrocracking) was performed at 700° C. for 13 seconds. Hydrogen gas at room temperature was mixed with the reaction product from the stainless steel tube to quench its temperature to 430° C. The mixture was freed of char in a char trap, and fed through an indirect water cooler and an indirect cooler using a cold solvent (−65° C.) to condense the liquid product and separate it from the gas. The liquid and gas products were analyzed for their composition.

To keep the reaction temperatures for the first and second steps constant, the respective reaction tubes were jacketed with electric heaters, and the hydrogen gas heating tube, the two reaction tubes and electric heaters were enclosed with a stainless steel pressure container (ID=500 mm). This arrangement obviated the need of making the reaction tubes with a pressure-resistant material. The first and second reactions were conducted at a pressure of 100 kg/cm$^2$G. The weight ratios of the hydrocracking hydrogen gas to the coal feed on a moisture- and ash-free basis were 0.5/1 and 0.71/1 for the first and second reactions, respectively.

The percent conversion of coal into various reaction products is shown in Table 2 below.

TABLE 2

| Reaction Product | Percent Conversion (wt %) |
|---|---|
| Methane | 27.3 |
| Ethane[1] | 9.1 |
| $CO + CO_2$ | 2.5 |
| $C_{3-5}$ hydrocarbons | 0.1 |
| Gasoline fraction | 15.6 |
| Heavy oil | 6.7 |
| Char | 38.7 |
| Total | 100.0 |

Notes:
[1]Ethylene accounted for about 5% of the ethane; the sum of ethane and ethylene is indicated as "ethane".

EXAMPLES 2 TO 9

Example 1 was repeated except that the temperature, time and pressure as well as the hydrocracking hydrogen to coal weight ratio for the first and second stage reactions were changed as indicated in Table 3. The reaction time was changed by suitably adjusting the length of the reaction tubes.

TABLE 3

| | Example No. | | | | | | | |
|---|---|---|---|---|---|---|---|---|
| | 2 | 3 | 4 | 5 | 6 | 7 | 8 | 9 |
| Reaction Parameters | | | | | | | | |
| Pressure (kg/cm$^2$G) | 100 | 100 | 100 | 100 | 200 | 50 | 100 | 100 |
| First Stage Reaction | | | | | | | | |
| Temperature (°C.) | 930 | 930 | 930 | 930 | 920 | 942 | 1050 | 830 |
| Duration (sec) | 0.12 | 0.12 | 0.12 | 0.12 | 0.08 | 0.08 | 0.032 | 0.62 |
| $H_2$/Coal[2] | 0.5 | 0.5 | 0.5 | 0.5 | 0.5 | 0.5 | 0.3 | 0.4 |
| Second Stage Reaction | | | | | | | | |
| Temperature (°C.) | 760 | 850 | 640 | 570 | 650 | 750 | 700 | 700 |
| Duration (Sec) | 6.4 | 3.0 | 27 | 57.8 | 11.9 | 8.7 | 15.2 | 15.6 |
| $H_2$/Coal[2] | 0.65 | 0.56 | 0.80 | 0.93 | 0.78 | 0.67 | 0.51 | 0.50 |
| Percent Conversion (%) | | | | | | | | |
| Methane | 29.6 | 38.1 | 25.1 | 22.5 | 24.9 | 28.7 | 33.8 | 26.8 |
| Ethane | 7.5 | 3.3 | 8.8 | 6.8 | 9.5 | 6.8 | 7.1 | 8.8 |
| $CO + CO_2$ | 2.3 | 2.6 | 2.4 | 2.2 | 2.4 | 2.5 | 2.6 | 2.2 |
| $C_{3-5}$ Hydrocarbon | 0.1 | 0.05 | 0.1 | 0.1 | 0.1 | 0.1 | 0.1 | 0.1 |
| Gasoline Fraction | 14.3 | 11.2 | 14.2 | 10.8 | 15.7 | 11.2 | 13.3 | 10.9 |
| Heavy Oil | 6.2 | 5.85 | 8.0 | 15.1 | 8.9 | 7.3 | 7.8 | 10.4 |
| Char | 40.0 | 39.0 | 41.4 | 42.5 | 38.5 | 43.4 | 39.3 | 40.8 |
| Total | 100.0 | 100.0 | 100.0 | 100.0 | 100.0 | 100.0 | 100.0 | 100.0 |

[2]$H_2$/coal represents the weight ratio of hydrocracking hydrogen to coal feed.

EXAMPLE 10

The same coal fines as used in Example 1 were employed. Hydrogen gas (1.0 kg/hr) at room temperature was heated to 900° C. at 100 kg/cm$^2$G in an externally heated Hastelloy X preheating tube (ID=5 mm), and further heated to 1,150° C. in an externally heated ceramic heating tube (ID=5 mm) connected to said preheating tube. Dry coal fines (2.5 kg/hr) at room temperature were continuously supplied through a table coal feeder at a pressure of 100 kg/cm$^2$G, carried by hydrogen gas (0.1 kg/hr, 100 kg/cm$^2$G) at room temperature, and injected into the stream of heated hydrogen gas so as to rapidly increase the coal temperature from room temperature up to 930° C. The coal heating rate is assumed to be about $2\times10^{5}$° C./sec. The mixture of coal and hydrogen gas was passed into an externally heated ceramic reaction tube (ID=6 mm) to perform the first stage reaction (thermal cracking) at 930° C. for 120 milli-seconds. Then, heavy oil (3.4 kg/hr) to be described below was atomized with hydrogen and mixed with the reaction product from the first stage reaction to quench it to 700° C. At the same time, the mixture was passed into an externally heated stainless steel reaction tube (ID=20 mm) connected to the ceramic reaction tube, and the second stage reaction (hydrocracking) was performed at 700° C. for 2 seconds. Hydrogen gas at room temperature was mixed with the reaction product from the stainless tube to quench it to 450° C. The mixture was freed of char in a cyclone char trap, and fed to a distillation column (ID=50 mm, height=3,000 mm) filled with a Raschig ring, and the heavy oil was recovered as bottoms, and the fractions lighter than the gasoline fraction were recovered as the distillate. The bottoms were recycled to quench the reaction product from the thermal cracking step, and any excess (ca. 0.1 kg/hr) was drawn from a recycling system. The distillate was cooled by an indirect water cooler to condense water and the gasoline fraction, which were separated by decantation, and part of the gasoline fraction was refluxed in the distillation column, with the remainder being drawn from the system. The uncondensed gas was gas-chromatographed for the contents of methane, ethane, ethylene, $CO+CO_2$, and gasoline fraction (mainly comprised of $C_{3-5}$ hydrocarbons). The same analysis was made for the heavy oil (bottoms), gasoline and water drawn from the system.

To keep the reaction temperatures for the first and second steps constant, the respective reaction tubes were jacketed with electric heaters, and the hydrogen gas heating tube, the two reaction tubes and electric heaters were enclosed with a stainless steel pressure container (ID=500 mm). This arrangement obviated the need for making the reaction tubes with a pressure-resistant material. The first through fourth reactions were conducted at a pressure of 100 kg/cm$^2$G. The weight ratios of the hydrocracking hydrogen gas to the coal feed on a moisture- and ash-free basis were 0.5/1 and 0.54/1 for the first and second reactions, respectively. The weight ratio of the recycled oil to the coal feed was 1.5/1 on a moisture- and ash-free basis.

The percent conversion of coal into various reaction products is shown in Table 4 below.

TABLE 4

| Reaction Product | Percent Conversion (wt %) |
|---|---|
| Methane | 26.0 |
| Ethane[1] | 10.3 |
| $CO + CO_2$ | 2.5 |
| $C_{3-5}$ | 0.1 |
| Gasoline fraction | 16.7 |
| Heavy oil | 5.2 |
| Char | 39.2 |
| Total | 100.0 |

Notes:
[1]See Table 2

COMPARATIVE EXAMPLES 1 TO 6

The reactor used in Example 1 was revamped so that nitrogen gas at room temperature could be fed to the end of the first reaction zone to quench the reaction product to thereby stop the reaction. Example 1 was repeated with a coal feed of 2.5 kg/hr except that the reaction temperature, time and pressure as well as the hydrocracking hydrogen to coal weight ratio were changed as indicated in Table 5 below. The figures for the "duration" are those around which the yield of the gasoline fraction was maximized.

TABLE 5

| | Comparative Example No. | | | | | |
|---|---|---|---|---|---|---|
| | 1 | 2 | 3 | 4 | 5 | 6 |
| Reaction Parameters | | | | | | |
| Pressure (kg/cm$^2$G) | 100 | 100 | 100 | 100 | 100 | 70 |
| Temperature (°C.) | 720 | 775 | 850 | 850 | 950 | 1000 |
| Duration (sec) | 9.0 | 6.0 | 7.5 | 0.5 | 0.4 | 0.2 |
| $H_2$Coal[2] | 0.5 | 0.5 | 0.5 | 0.5 | 0.4 | 0.6 |
| Percent Conversion (%) | | | | | | |
| Methane | 21.6 | 27.6 | 34.4 | 22.5 | 39.8 | 42.3 |
| Ethane | 5.8 | 5.2 | 4.1 | 2.6 | 1.5 | 0.5 |
| $CO + CO_2$ | 2.3 | 2.6 | 2.4 | 2.3 | 2.3 | 2.4 |
| $C_{3-5}$ Hydrocarbon | 0.1 | 0.08 | 0.1 | 0.1 | 0.04 | 0.05 |
| Gasoline fraction | 7.9 | 9.8 | 8.5 | 6.5 | 7.2 | 8.0 |
| Heavy oil | 12.0 | 10.72 | 12.4 | 23.3 | 9.86 | 7.35 |
| Char | 50.3 | 44.0 | 38.1 | 42.7 | 39.3 | 39.4 |
| Total | 100.0 | 100.0 | 100.0 | 100.0 | 100.0 | 100.0 |

[2]See Table 3

The process of the present invention has the following advantages over the comparative techniques for coal liquefaction and gasification:

(1) The percent conversion of coal into the gasoline fraction is increased by from 60 to 70%;

(2) The percent conversion of coal into ethane is increased by from 50 to 78%;

(3) The percent total conversion of coal is as high as the conventionally achieved level (ca. 60%), and yet the percent conversion to methane is reduced by about 20%, and as a result, the consumption of hydrocracking hydrogen, gas, hence the cost for manufacturing hydrogen, is reduced;

(4) If cooling hydrogen gas is supplied to quench the temperature of the reaction product being transferred from the first reaction zone to the second reaction zone, coking in the second reaction zone can be reduced; and (5) The reaction product being transferred from the first reaction zone to the second reaction zone can also be quenched by recycling the heavy oil to the end of the first reaction zone, and this eliminates the cost of recovering an externally supplied cooling medium.

While the invention has been described in detail and with reference to specific embodiments thereof, it will be apparent to one skilled in the art that various changes and modifications can be made therein without departing from the spirit and scope thereof.

What is claimed is:

1. A process for liquefying and gasifying coal by thermal treatment in the presence of hydrogen gas for hydrocracking, said process comprising the following sequential uninterrupted three steps:

(1) injecting coal fines into a heated hydrogen gas stream at a pressure of from 35 to 250 kg/cm$^2$G such that they are rapidly heated to a temperature of from 750° to 1100° C. for thermal cracking thereof; immediately thereafter (2) reducing the temperature of the reaction product stream while subjecting the resulting product to hydrocracking for a period of from 1.0 to 60 seconds at a temperature that is lower than the temperature used in step (1) and which is in the range of from 570° to 850° C.; and (3) rapidly quenching the reaction product of step (2) to not lower than 350° C. to stop the hydrocracking.

2. A process according to claim 1, wherein the rate of heating the coal in the first step is at least 2,000° C./sec.

3. A process according to claim 1, wherein the weight ratio of hydrocracking hydrogen gas to the coal feed supplied in the first step (on a moisture- and ash-free basis) is from 0.1/1 to 1.5/1.

4. A process according to claim 1, wherein the reaction product of step (1) is subjected to indirect heat exchange with the hydrocracking hydrogen gas in part of or throughout step (2) so as to quench said reaction product and at the same time achieve preliminary heating of the hydrocracking hydrogen gas.

5. A process according to claim 1, wherein hydrogen gas whose temperature is lower than the reaction temperature for step (2) is supplied at the end of step (1) to quench the reaction product of step (1) and adjust to the reaction temperature for step (2).

6. A process according to claim 1, wherein the reaction product of step (1) is cooled both by indirect heat exchange with the hydrocracking hydrogen gas supplied in step (1) and by supplying hydrogen gas whose temperature is lower than the reaction temperature for step (2).

7. A process according to claim 1, wherein steps (1), (2) and (3) are followed by a sequence of the following three steps:

step (4) separating char from the reaction product of step (3);

step (5) cooling the char-free reaction product of step (4) to separate heavy oil therefrom; and step (6) recycling at least part of the separated heavy oil from step (5) to the end of step (1).

8. A process according to claim 7, wherein the heavy oil is recycled according to in step (6) after being heated to a vapor state, or by being atomized together with water vapor or hydrogen gas.

9. A process according to claim 1, 2, 3, 4, 5, 6, 7, or 8, wherein the temperature in step (1) is from 800° to 1050° C., the pressure in step (1) is from 50 to 200 kg/cm$^2$G, and the temperature in step (2) is from 600° to 800° C.

10. A process according to claim 9, wherein the duration of step (1) is from 20-milli-seconds to 1,500 milli-seconds and the duration of step (2) is from 1.0 to 60 seconds.

* * * * *